US009410336B2

(12) United States Patent
DeVerse

(10) Patent No.: US 9,410,336 B2
(45) Date of Patent: Aug. 9, 2016

(54) AUTOMATED SYSTEM FOR MONITORING AND MAINTENANCE OF FLUID LEVEL IN SWIMMING POOLS AND OTHER CONTAINED BODIES OF WATER

(76) Inventor: Richard DeVerse, Kailua-Kona, HI (US)

( * ) Notice: Subject to any disclaimer, the term of this patent is extended or adjusted under 35 U.S.C. 154(b) by 245 days.

(21) Appl. No.: 12/791,687

(22) Filed: Jun. 1, 2010

(65) Prior Publication Data

US 2010/0300548 A1 Dec. 2, 2010

Related U.S. Application Data

(60) Provisional application No. 61/182,989, filed on Jun. 1, 2009.

(51) Int. Cl.
*E04H 4/12* (2006.01)

(52) U.S. Cl.
CPC ..... *E04H 4/12* (2013.01); *Y10T 137/7287* (2015.04)

(58) Field of Classification Search
CPC ..... G01N 2030/025; G01N 2030/8881; G01N 30/20; G01M 3/3245; F16K 11/022; E04H 4/12; Y10T 137/7287
USPC ..... 73/304 C, 304 R; 137/386, 392, 393
See application file for complete search history.

(56) References Cited

U.S. PATENT DOCUMENTS 3,538,746 A 11/1970 Jacobs et al.
3,732,556 A 5/1973 Caprillo et al.
3,739,405 A 6/1973 Schmidt
3,848,627 A * 11/1974 Page ..... 137/392
4,115,877 A * 9/1978 Wall ..... 4/508
4,194,691 A * 3/1980 Birnbach et al. ..... 239/63
4,373,815 A 2/1983 Bruce
4,380,091 A * 4/1983 Lively ..... 4/508

(Continued)

FOREIGN PATENT DOCUMENTS

WO WO 2006067148 A2 * 6/2006 ..... G01F 23/26

OTHER PUBLICATIONS

Machine Translation of Barlesi et al. WO 2006/067148.*

(Continued)

*Primary Examiner* — Eric Keasel
*Assistant Examiner* — Frederick D Soski
(74) *Attorney, Agent, or Firm* — Knobbe, Martens Olson & Bear, LLP

(57) ABSTRACT

An automated system for monitoring and maintaining fluid level in a swimming pool, spa, or other environment containing water is provided. The system includes a sensor assembly having a microprocessor and a proximity sensor encapsulated in a non-conductive material. A lower section of the sensor assembly has a flat profile and at least a portion of the proximity sensor is positioned in the lower section. The sensor assembly transmits a signal to a remote controller when the water level measured is above or below a predetermined target value. The remote controller in turn causes a remote water valve to turn on or off. In certain implementations, the sensor assembly incorporates a precision mounting system and algorithm, which work together to provide the end user with a means to mount the sensor easily and maintain precise operational level of the water. The combination of the physical mounting system and the range and resolution of the proximity sensor allow for precise maintenance of water level at the preferred level.

6 Claims, 14 Drawing Sheets

(56) References Cited

U.S. PATENT DOCUMENTS

| | | | | |
|---|---|---|---|---|
| 4,483,192 | A | 11/1984 | Wachter | |
| 4,491,146 | A * | 1/1985 | Sveds | 137/341 |
| 4,591,839 | A * | 5/1986 | Charboneau et al. | 340/620 |
| 4,612,949 | A | 9/1986 | Henson | |
| 4,706,310 | A * | 11/1987 | Magnes | 4/508 |
| 4,813,275 | A | 3/1989 | Castor | |
| 4,817,217 | A * | 4/1989 | Lively | 4/508 |
| 4,986,113 | A | 1/1991 | Harrison et al. | |
| 5,132,923 | A | 7/1992 | Crawford et al. | |
| 5,157,968 | A | 10/1992 | Zfira | |
| 5,315,873 | A | 5/1994 | Jin | |
| 5,427,136 | A * | 6/1995 | Weishew | 137/392 |
| 5,517,022 | A | 5/1996 | Bock et al. | |
| 5,734,096 | A | 3/1998 | McGuigan et al. | |
| 5,878,447 | A * | 3/1999 | Mogab et al. | 4/508 |
| 5,971,011 | A | 10/1999 | Price | |
| 5,975,102 | A * | 11/1999 | Schalk | 137/2 |
| 6,026,683 | A | 2/2000 | Lee | |
| 6,532,814 | B2 | 3/2003 | Bromley | |
| 6,568,264 | B2 * | 5/2003 | Heger | 73/304 C |
| 6,611,968 | B1 * | 9/2003 | Swanson et al. | 4/508 |
| 6,625,824 | B1 | 9/2003 | Lutz et al. | |
| 6,700,503 | B2 | 3/2004 | Masar et al. | |
| 6,851,314 | B2 | 2/2005 | Bromley | |
| 6,910,498 | B2 | 6/2005 | Cazden | |
| 6,964,278 | B2 * | 11/2005 | Tschanz | 137/392 |
| 7,004,011 | B1 | 2/2006 | Spiegel | |
| 7,318,344 | B2 | 1/2008 | Heger | |
| 7,343,794 | B1 | 3/2008 | Pucel et al. | |
| 7,370,528 | B2 * | 5/2008 | Scardovi | 73/304 C |
| 8,220,482 | B1 | 7/2012 | DeVerse et al. | |
| 2002/0029633 | A1 | 3/2002 | Yekutiely et al. | |
| 2004/0035465 | A1 | 2/2004 | Cazden | |
| 2006/0032862 | A1 | 2/2006 | Miller | |
| 2006/0096659 | A1 | 5/2006 | Reusche et al. | |
| 2006/0110292 | A1 | 5/2006 | Deverse et al. | |
| 2007/0211076 | A1 | 9/2007 | Kates | |
| 2008/0019874 | A1 | 1/2008 | Deverse et al. | |
| 2008/0144238 | A1 | 6/2008 | Cline et al. | |
| 2011/0120219 | A1 * | 5/2011 | Barlesi et al. | 73/304 C |

OTHER PUBLICATIONS

International Search Report and Written Opinion, Application No. PCT/US2010/36942, dated Jul. 28, 2010, 7 pages.

International Preliminary Report on Patentability, Application No. PCT/US2010/36942, dated Dec. 15, 2011, 7 pages.

"Introduction to Load Cells", website screenshot, http://www.omega.com/prodinfo/LoadCells.html, 5 pgs.

Screenshot of online webpage for Username goolsnfc. Leakalyzer Exposed. YouTube [online], posted Sep. 19, 2008 [last visited Jul. 29, 2009]. Available at: <URL: http://www.youtube.com/watch?v=ZbkgNy68blA >.

Screenshot of online webpage for Username Leaktools, Leakalyzer Set-up. YouTube [online], posted Jun. 16, 2008 [last visited Jul. 29, 2009]. Available at: <URL: http://www.youtube.com/watch?v=-J74zJx5OL0 >.

Screenshot of online webpage for Username Leaktools, Anderson Leakalyzer Demo. YouTube [online], posted Jun. 6, 2008 [last visited Jul. 29, 2009]. Available at: <URL: http://www.youtube.com/watch?v=NzeJls7KaYk >.

Screenshot of online webpage for Username Leaktools Leakalyzer Pool Demo 1. YouTube [online], posted Jun. 13, 2008 [last visited Aug. 6, 2009]. Available at: <URL: http://www.youtube.com/watch?v=bsOXZZmSNgE >.

Screenshot of online webpage for Username konalabs. Kona Labs LOKOPOD LP-2750 Leak Sensor Quick Setup. YouTube [online], posted Aug. 20, 2008 [last visited Jul. 29, 2009]. Available at: <URL: http://www.youtube.com/watch?v=iXnbxtflYpM >.

Screenshot of online webpage for Username konalabs. Kona Labs LP-2750 Professional Pool & Spa leak sensor setup procedure. YouTube [online], posted Sep. 3, 2008 [last visited Jul. 29, 2009]. Available at: <URL: http://www.youtube.com/watch?v=g8A6aaKKgrk >.

Screenshot of online webpage for Username konalabs. Hawaii Island's Kona Labs Leak Detection Services. YouTube [online], posted Sep. 23, 2008 [last visited Aug. 6, 2009]. Available at: <URL: http://www.youtube.com/watch?v=l6db2MfZI7w >.

Screenshot of online webpage for Username konalabs. LP-2750 Pool Leak Sensor Quick Setup Procedure. YouTube [online], posted Sep. 23, 2008 [last visited Aug. 6, 2009]. Available at: <URL: http://www.youtube.com/watch?v=lrdhcT3cKeA >.

Screenshot of online webpage for Username konalabs. Kona Labs LokoPod(TM) LP-2750(TM) Pool and Spa Leak Sensor. YouTube [online], posted Aug. 2, 2008 [last visited Aug. 6, 2009]. Available at: <URL: http://www.youtube.com/watch?v=kyun3csfQXQ >.

Screenshot of online webpage for Username videosearchit. Florida Leak Locators finds leaks in your pool—see how! YouTube [online], posted Jul. 31, 2007 [last visited Jul. 29, 2009]. Available at: <URL: http://www.youtube.com/watch?v=bWxB2vmZZ6w >.

Screenshot of online webpage for Username ALDJosh. Swimming Pool Leak—KZSW—Temecula. YouTube [online], posted Sep. 21, 2007 [last visited Jul. 29, 2009]. Available at: <URL: http:www.youtube.com/watch∞v=HRftnQM4NwM >.

* cited by examiner

AUTOMATED SYSTEM FOR MONITORING AND MAINTENANCE OF FLUID LEVEL IN SWIMMING POOLS AND OTHER CONTAINED BODIES OF WATER

CROSS-REFERENCE TO RELATED APPLICATIONS

This application claims the benefit of priority under 35 U.S.C. §119(e) of U.S. Provisional Application No. 61/182,989 filed on Jun. 1, 2009, which is incorporated herein by reference in its entirety.

BACKGROUND OF THE INVENTION

1. Field of the Invention

The present disclosure generally relates to monitoring and maintenance of fluid level in pools, spas, ponds, water features, storage tanks, and other liquid containers, and more particularly, relates to automated fluid fill systems and methods for controlling the fluid level in swimming pools, spas, and the like.

2. Description of the Related Art

Various automated water level control systems have been developed for swimming pools, spas, storage tanks, and other containers of fluid. However, one of the challenges in regulating liquid level in a container located in an open environment such as an outdoor swimming pool is that it is difficult to differentiate between actual changes in liquid level versus perceived changes caused by surface turbulence. For example, the amplitude of water waves and other surface turbulence in a swimming pool can often be greater than the amplitude of the actual changes being measured, thus causing the signal to noise ratio of the sensor response to be much less than one, which in turn can adversely affect the accuracy of the data.

Some water level control systems incorporate sensors that utilize baffles or other physical means to reduce water level fluctuations caused by surface turbulence. However, these sensors require extensive testing under static conditions in order to achieve measurements that are meaningful. Water level control systems that incorporate more sensitive sensors capable of faster measurements often suffer from high noise due to large wave amplitudes on the surface of the liquid being measured. Moreover, the water level sensors are typically mounted at a location arbitrarily selected by the installer. The operational level and the sensor level as mounted is an important relationship. In some cases, the sensors are attached to the side of a skimmer by tape or Velcro, which could add variability and inconsistency to the sensor level relative to the water. As such, the sensor may not be affixed at the correct level required for optimal system performance.

In view of the foregoing, there is a need for an improved automated system and method for accurately controlling water fill functions in pools, spas, or other contained bodies of water.

SUMMARY OF THE INVENTION

The systems, devices, and methods of the invention each have several aspects, no single one of which is solely responsible for its desirable attributes. Without limiting the scope of this invention, its more prominent features will now be discussed briefly. After consideration of this discussion and particularly after reading the section entitled "Detailed Description of Preferred Embodiments," one will understand how the features of the invention provide advantages that include, for example, rapid and accurate monitoring and maintenance of water level in a swimming pool or other contained body of liquid with surface turbulence.

Certain preferred embodiments of the present invention provide a system designed to rapidly and accurately measure mean surface level (MSL) changes in a contained body of fluid, such as water in a swimming pool or spa or liquid in a storage tank. In one implementation, the system incorporates a proximity sensor, a novel mounting assembly, and algorithms, which together are adapted to obtain meaningful and rapid results for the end user. Preferably, the appropriate combination of physical properties of the sensor system, the sensitivity and range of the sensor, and the algorithmic methods developed enable rapid determination of MSL changes in a container. The system can be used as an automated water fill system for pools, spas, water features and can enable quick determination of water level changes. The system is simple to mount in an approximate position and can also provide enough resolution and range to accommodate variability in mounting conditions, range and resolution constraints.

In one aspect, the preferred embodiments of the present invention provide an automated system for monitoring and maintaining fluid level in an environment containing a fluid, such as water. The system generally comprises a sensor assembly and a remote controller. The sensor assembly generally comprises a proximity sensor and a transmitter. In one embodiment, the proximity sensor comprises one or more conductors encapsulated in a substantially non-conductive material, such as epoxy. In one implementation, the conductors have a layer of non-conductive material coated thereon, wherein the thickness of the non-conductive material can be up to about 7 mm thick. The conductors are preferably disposed in a lower section of the sensor assembly, which has a generally flat profile. The remote controller is operatively connected to at least one fluid valve and in communication with the sensor assembly. The sensor assembly is capable of sensing fluid level changes in the environment by measuring the amount of time required for the conductors to charge to a preset potential. Furthermore, the sensor assembly is capable of transmitting a signal to the remote controller when the measured fluid level deviates from a predetermined target value. Preferably, the remote controller is adapted to turn the fluid valve on or off in response to the signal. In one implementation, the lower section of the sensor assembly has a cross-sectional thickness of between 2 and 10 mm. In another implementation, the sensor assembly further comprises a substantially watertight housing that encloses the conductors in a manner such that the conductors do not directly contact the fluid. The environment containing fluid can be a swimming pool, spa, or irrigation landscape, or other fluid containers.

In yet another aspect, the preferred embodiments of the present invention provide a method of controlling water level in an environment containing water. The method comprises positioning a coated conductor in the environment containing water, wherein the coated conductor is coated with a layer of non-conductive material and measuring the change in time for the coated conductors to charge to a set potential. The method further comprises correlating the change in time v. potential to a change in water level in proximity to the coated conductor and comparing the change in water level to a threshold water level. The method further comprises transmitting a wireless signal to a remote controller to trigger automatic water fill if the water level is below the threshold water level and to trigger water shut-off if the water level is above the threshold water level.

In yet another aspect, the preferred embodiments of the present invention provide a kit for automatic monitoring and maintaining of water level in a swimming pool. The kit comprises a sensor that is capable of detecting water level changes in the swimming pool and is capable of transmitting a signal if the water level is below a threshold level. The kit further comprises a spacer having a plurality of slots disposed in a spaced apart relationship, wherein the spacer is configured to couple with the sensor pod. The kit further comprises an attachment device for attaching the sensor and spacer on the underside of a skimmer deck lid and an algorithm working in concert with the mounting system. The algorithm and mechanical mounting system work together to provide the end user with a means to mount the sensor easily and to maintain precise operational level of the water. The combination of the physical mounting system and the range and resolution of the proximity sensor allow for precise maintenance of water level at the preferred level. Preferably, the spacer and attachment device are dimensioned to allow the sensor to extend a first depth into the water when the swimming pool water level is at the threshold level. In one implementation, the first depth is about 20 to 25 mm. The kit further comprises a water valve and a remote controller configured to be operatively connected with the water valve and in communication with the sensor pod.

In yet another aspect, the preferred embodiments of the present invention provide a system for automated control of fill functions in a swimming pool. The system comprises a sensor pod having a sensor that is disposed inside the sensor pod. Preferably, the sensor communicates with a remote controller to fill water into the pool when the water mean surface level falls below a predetermined lower threshold and, in some embodiments, to also drain water from the pool when the water mean surface level exceeds a predetermined upper threshold.

In certain embodiments, the system can be configured as a permanent sensor installation for liquid inventory control functions and water conservation. The system can be used in functions related to the measurement of the mean surface level in liquids in containers including but not limited to water, petrochemicals, organic solvents, wet chemicals and fuels either closed or open, above or below ground. The system also relates to automated control of fill and drain functions for containers and liquid inventory monitoring such as water feature automated fill functions, water use monitoring and water conservation. One preferred implementation is an automatic fill, activity and security system for swimming pools that can be enabled by algorithms to detect leaking conditions, detect high water use, detect pool activity and can provide a pool safety function designed to alarm pool owners on pool activity that is sensed to be similar to distress or drowning. By application of different signal recognition algorithms in combination with conductor patterns and arrangements, the sensor can be enabled to function in different ways. In one embodiment, the system can be used as a multi-function pool monitoring device. Water lost due to evaporation or splash out will be replaced and the fill algorithm will fill the pool to a predetermined level. The system provides improvement to the automatic filler by enabling complex processing of the actual mean surface level of the system so that analytical algorithms and feature recognition algorithms can be used to detect if losses of fluids are due to leaks in the pool system or are from typical use or from accidental entry and distress. If a leak is detected the owners can be alerted to initiate a repair and eliminate the loss of water resources. If the leak is from distress, emergency alerts can be issued.

The system of the preferred embodiments can be used as a rapid leak sensor for pools and spas, a professional tool that is portable and can be transported from container to container for testing in the field. In one preferred embodiment, the sensor pod is attached to a precision mount that allows anchoring or setting the base on the side of the pool or spa or container and lowering the sensor to depth into the liquid inside of the container under test. In another preferred embodiment, a remote controller is able to receive data from the sensor pod so positioned in the container to be in contact with the water and capable of measuring changes in the mean surface level. By anchoring the sensor and having a cable or wireless connection to a remote controller, the user can measure the mean surface level change in the body of liquid and determine the loss or gain in the amount of liquid in the container. In one preferred embodiment as a leak sensor for pools and spas, the data would be processed for display on a graphical readout screen and the data may be processed to display the data in both graphical means and in units selected by the user. In one preferred embodiment the graphical display would collect data from the sensor digitize it and send the data to the handheld controller unit for processing. In one preferred embodiment an algorithm would collect multiple data values from the sensor in rapid succession over a period of seconds and average this data into a single data value. This data value would then be used to calculate a running calculation of a best fit of data to determine slope of change with time. This data would be processed by this one preferred embodiment to display the slope data and or the raw data on the graphical display. A number representing the leak rate will be calculated and displayed in this preferred embodiment. In one preferred embodiment the user can enter in the size and shapes of the containers surface to allow a calculation of the rate of fluid flux in terms of volume units such as gallons or liters per unit time such as hours or days. In one preferred embodiment the data can be collected for a period of time and stored in a single file representing the data for that container that can be recalled or processed at a later date.

In yet another preferred embodiment, the system can be used to monitor liquid inventory management. By using a liquid level measurement system of the preferred embodiments to provide near real-time level measurements of liquid in containers liquid inventory can be managed. Leaks can be assessed rapidly in the plumbing systems of the containers and the containers themselves.

BRIEF DESCRIPTION OF THE DRAWINGS

These and other features, aspects, and advantages of the systems and methods disclosed herein are described below with reference to the drawings of preferred embodiments, which are intended to illustrate and not to limit the invention. Additionally, from figure to figure, the same reference numerals have been used to designate the same components of an illustrated embodiment. The following is a brief description of each of the drawings.

DETAILED DESCRIPTION OF PREFERRED EMBODIMENTS

Figure 1:
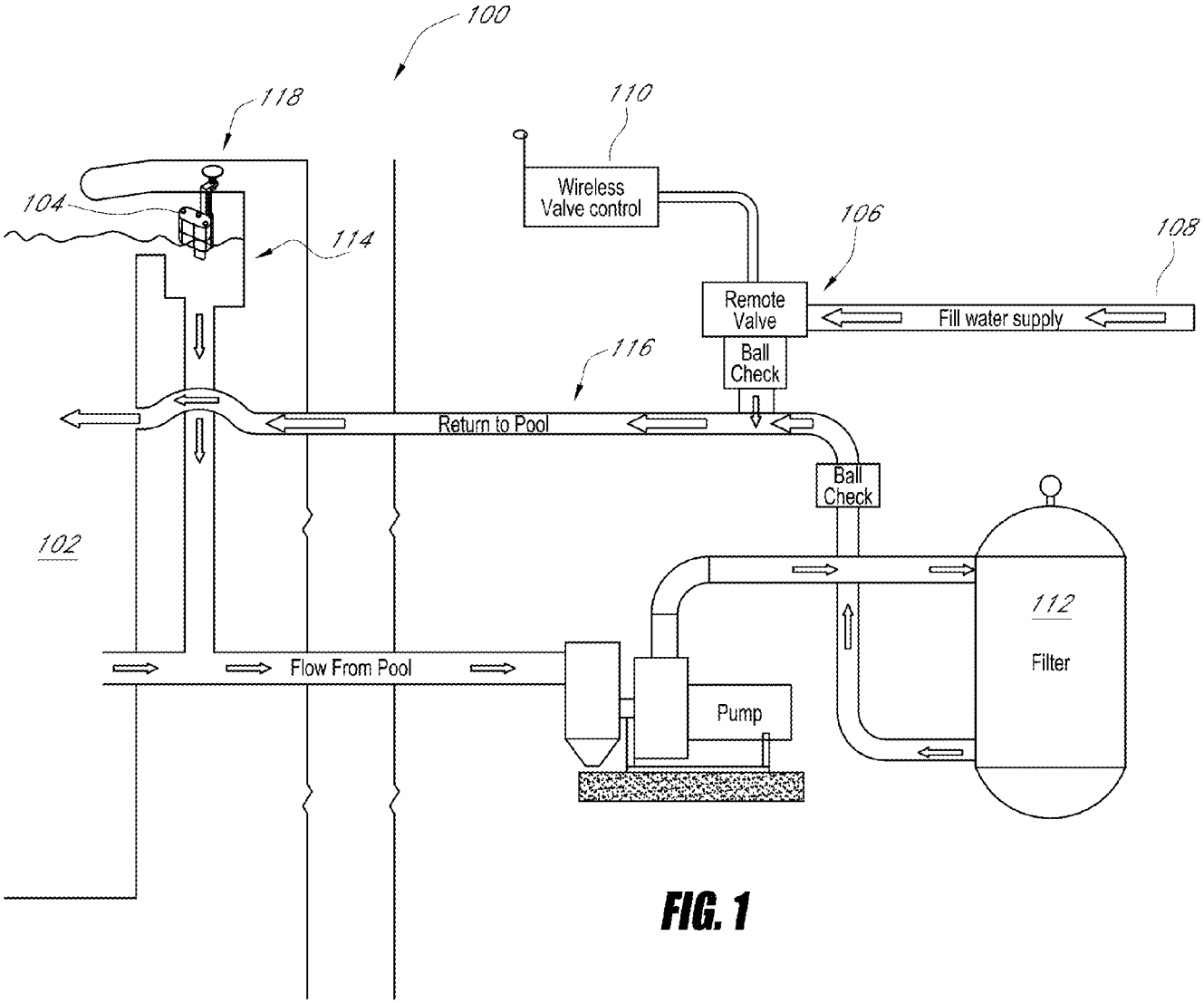
FIG. 1 is a schematic illustration of an automated water level monitor and maintenance system of one preferred embodiment.

FIG. 1 is a schematic illustration of an automated water level monitor and maintenance system 100 of a preferred embodiment, which can be used to control the water level in a swimming pool 102. The system 100 generally includes a sensor assembly 104 adapted to measure water level in the pool 102, a remote water valve 106 adapted to control the flow of fill water supply 108, and a remote controller 110 operatively connected to the remote water valve 106 and in communication with the sensor assembly 104. As shown in FIG. 1, water from the pool 102 is circulated through a filter system 112 via drains and pipes in a manner known in the art. Skimmers 114 are positioned around the pool 102 to remove debris floating on the very top of the pool. Fill water supply 108 can be introduced to the pool 102 through the remote water valve 106 and the water return line 116.

In one implementation, the sensor assembly 104 is mounted to a surface that provides a fixed reference level relative to the pool, such as the underside of the skimmer deck lid 118 as shown in FIG. 1. As described in greater detail below, the sensor assembly 104 incorporates a novel mounting system that facilitates precise positioning of the sensor assembly at a preselected operational level relative to the water so that accurate water level measurements can be made. Generally, the sensor assembly 104 is adapted to measure the water level in the pool 102 and send a "low water" signal to the remote controller 110 when the water level falls below a predetermined threshold level, which in turn triggers the remote controller 110 to turn on the remote water valve 106, such as a solenoid valve, to add fill water to the pool. When the water level has reached the predetermined threshold level, there are various ways to trigger the remote controller 110 to turn off the remote water valve 106. For example, the sensor assembly 104 can transmit a "close valve" signal to the remote controller, or the sensor assembly can simply stop transmitting the "low water" signal, both of which can serve as triggers for the remote controller to shut off the remote water valve. As described in greater detail below, the sensor assembly is designed to rapidly and accurately detect water level changes in swimming pools even where the water can be turbulent due to the effects of weather and other disturbances.

Figure 2:
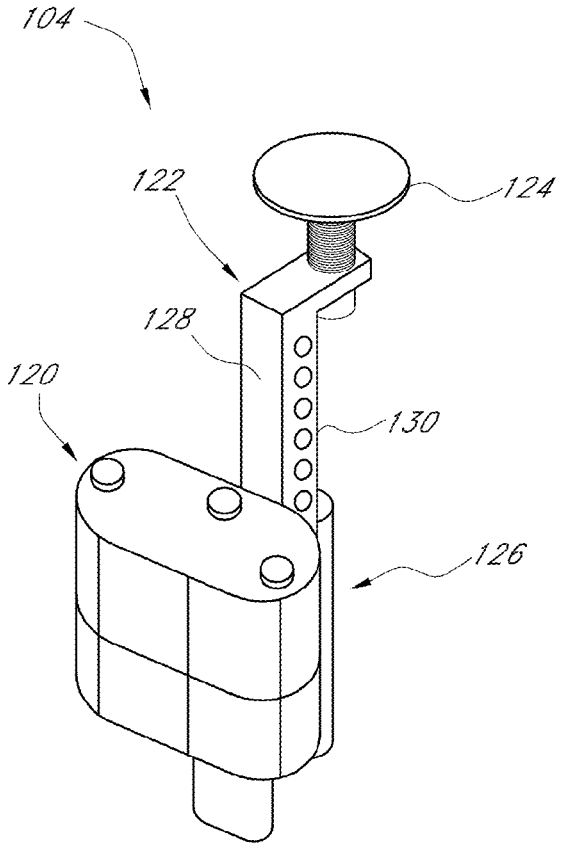
FIG. 2 is a perspective view of a sensor assembly of one preferred embodiment.

FIG. 2 provides a perspective view of the sensor assembly 104, showing the sensor assembly 104 comprising a sensor pod 120, a precision mount system 122, and an attachment device 124. The precision mount system 122 and the attachment device 124 are configured to precisely affix the sensor pod 120 at a predetermined level relative to the water in the pool. The sensor pod 120 is configured to couple with the precision mount system 122 via a bracket 126 or the like. In one implementation, the precision mount system 122 comprises a spacer 128 with a plurality of slots 130 extending along the spacer 128 in a spaced apart relationship. In one embodiment, the spacer 128 is about 100 mm long and the distance between adjacent slots is about 10 mm. The sensor pod 120 can be precisely affixed and locked at multiple predetermined levels by simply inserting a pin through the bracket 126 and the appropriate slots 130 on the spacer 128. The entire sensor assembly 104 in turn can be mounted to a surface with a fixed reference level using the attachment device 124, which in the embodiment shown in FIG. 2 comprises a nut and bolt arrangement. Advantageously, the precision mount system 122 and attachment device 124 allow the sensor pod 120 to be easily mounted at a precise level required for optimal operation of the sensor assembly and eliminates the variability introduced by operator dependent mounting methods such as taping or the like.

Figure 3A:
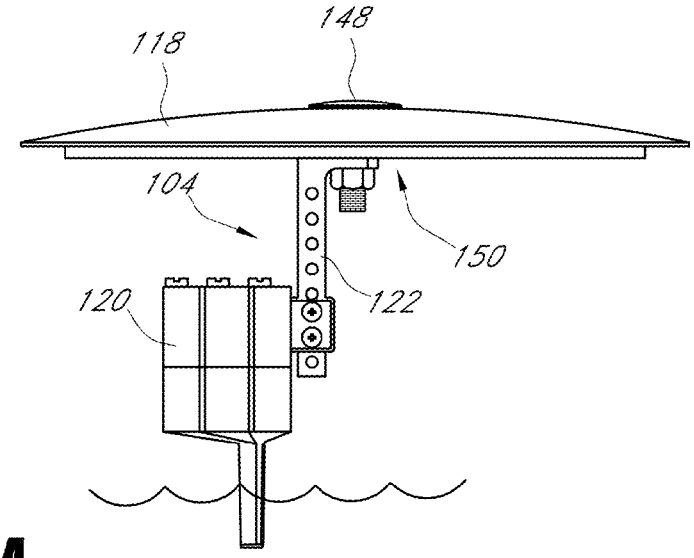
FIGS. 3A and 3B illustrate the sensor assembly mounted to the underside of a skimmer deck lid according to one preferred embodiment; an exploded view of the sensor assembly is shown in FIG. 3B.
Figure 3B:
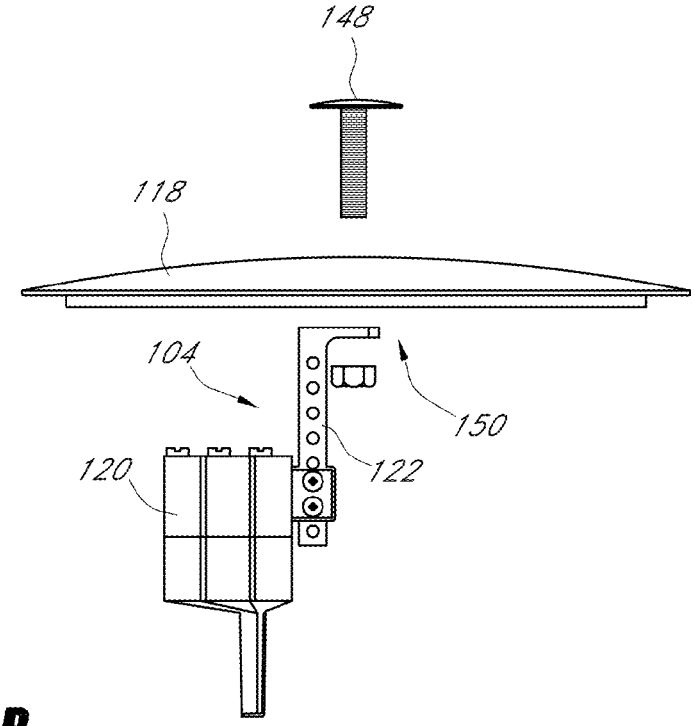

FIG. 3A illustrates the sensor assembly 104 mounted on the underside of a skimmer deck lid 118 according to one preferred embodiment. An exploded view of the sensor assembly 104 is illustrated in FIG. 3B. The sensor assembly 104 is mounted to the skimmer cover or deck lid 118 in a manner such that the sensor pod 120 is positioned below the deck lid 118 and extends downwardly into the water. A bolt 148 is preferably inserted through an existing opening 150 formed in the center of the skimmer cover or deck lid. In alternative embodiments, an opening can be drilled into the skimmer cover or deck lid. Since the skimmer cover or deck lid provides a fixed reference level relative to the water in the pool, the sensor pod 120 attached to the precision mount system 122 can be easily and consistently mounted at the desired level. While the illustration shows the sensor assembly being mounted on the underside of a skimmer deck lid, other surfaces with fixed reference level can also be used as a mounting surface for the sensor assembly using the precision mount system.

Figure 4:
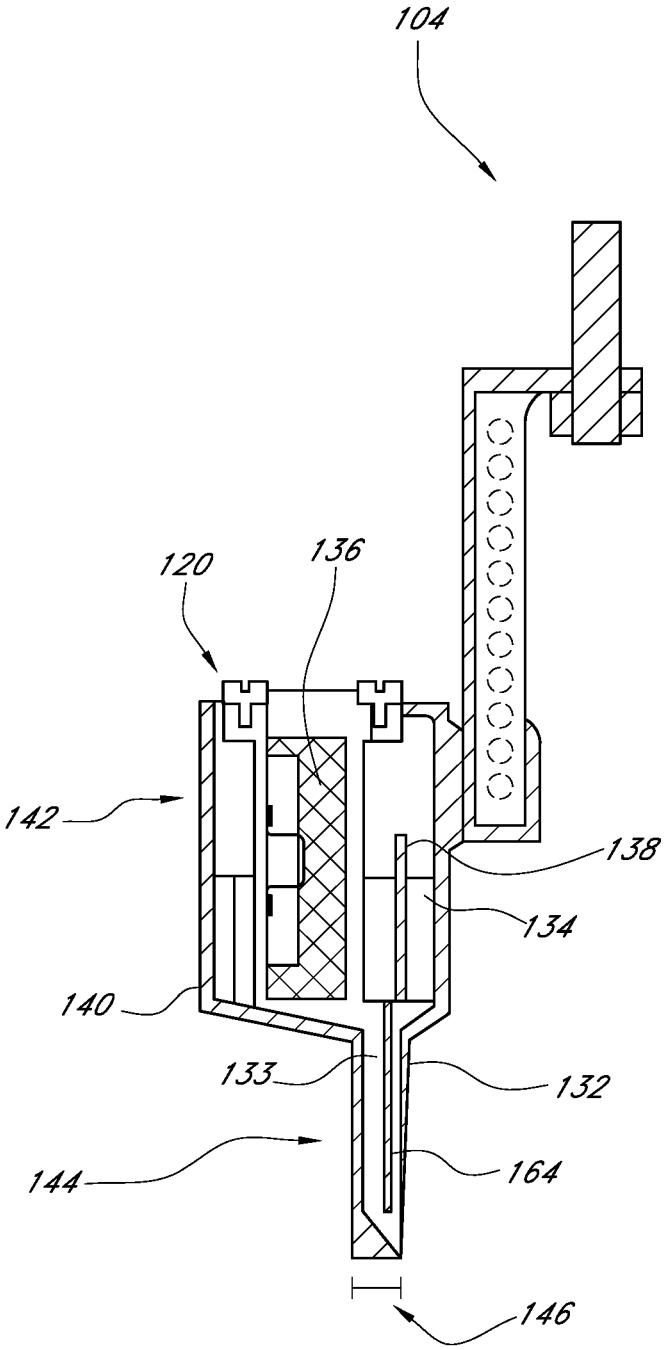
FIG. 4 is a cut-away view of the sensor assembly, showing the components inside the sensor pod.

FIG. 4 is a cut-away view of the sensor assembly 104 showing the components of the sensor pod 120. The sensor pod 120 comprises a proximity sensor 132 encapsulated in a resin 133, a microcontroller 134, a battery pack 136, and a transmitter 138, all enclosed inside a substantially watertight plastic housing 140. The housing 140 has a substantially rectangular upper section 142 configured to accommodate the hardware and a substantially flat lower section 144 configured to accommodate conductors that are part of the proximity sensor. The lower section 144 will be at least partially immersed in water when the sensor assembly is mounted. When the lower section 144 of the housing is immersed in water, the proximity sensor 132 is separated from the water by the walls of the housing and the resin therebetween. The inventor has found that certain properties related to the structure and material of the sensor pod, either individually or in combination, can affect the speed and accuracy of water level measurement. For example, for improved data accuracy, the thickness of the housing wall adjacent to the proximity sensor is preferably between about 1 mm to 3 mm; the dielectric constant at 1 KHz of the housing wall and resin between the proximity sensor and water is preferably about 3; and/or the dielectric constant of the resin is preferably about 2 to 3. In certain preferred embodiments, the lower section 144 has an average cross-sectional thickness 146 of less than about 10 mm. Advantageously, the sensor assembly 104 is designed to measure the water level without requiring water to contact components inside the housing or enter the housing, which enhances the accuracy of the measurements and reduces the need for replacing components due to water damage.

Figure 5:
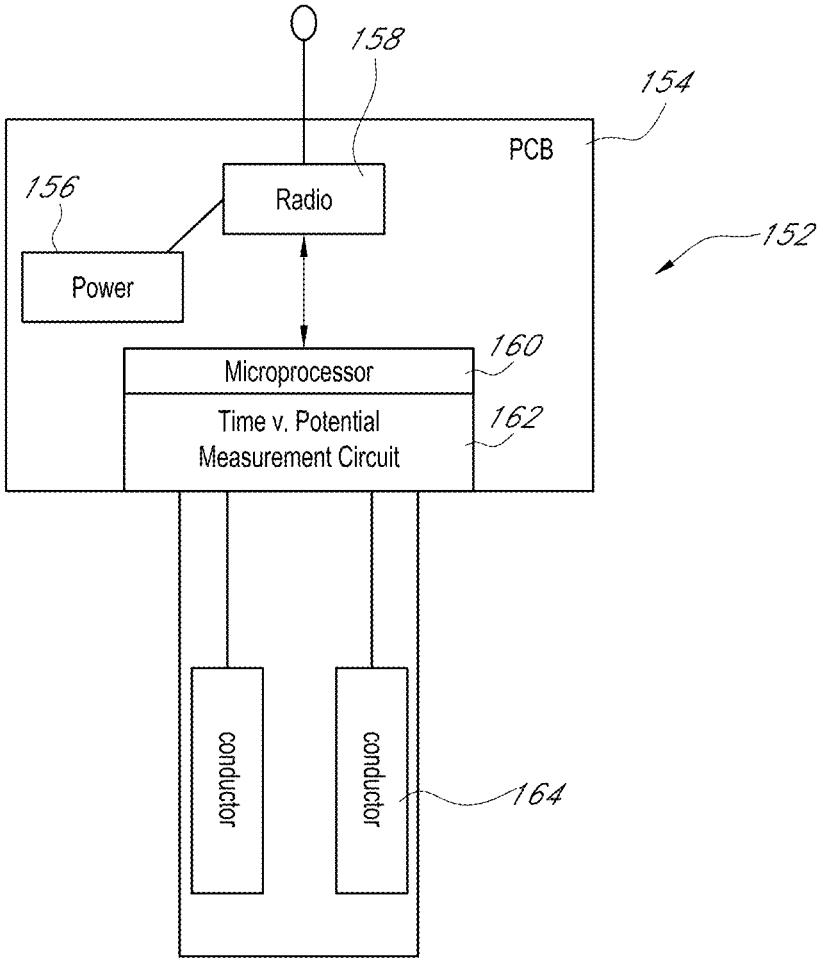
FIG. 5 is a schematic illustration of a sensor pod of one preferred embodiment.

FIG. 5 is a schematic illustration of a sensor pod 152 of another preferred embodiment. The sensor pod 152 generally comprises a power source 156, a radio frequency transmitter 158, a microprocessor 160, a time vs. potential measurement circuit 162, and a plurality of conductors 164 encapsulated in a non-conductive material and interconnected to the circuit 162. The sensor pod 152 senses water level changes by measuring the amount of time required to charge the conductors to a set voltage level at predetermined time intervals. By adding conductors and incorporating different shapes, patterns and signal averaging sensitivity on level change measurements can be optimized. Changes in the amount of time are correlated to changes in the level of water in near proximity to the conductors. For example, in one embodiment, a certain percent change in the amount of time correlates to a proportional percent change in the water level. The proportionality constant can vary, depending on the configuration of the conductors, the sensor pod, and other factors. Without wishing to be bound by theory, it is believed that material surrounding the conductors affect the amount of time it takes to charge the conductors to a set voltage. Measuring the time to charge the conductors to a set voltage or measuring the voltage at a set time allows changes to be sensed in the proximity of conducting material, such as water, surrounding the conductors. Encapsulating the conductors with a non-conductive material further allows for sensitive change detection in near proximity conductive materials, such as water. As such, the water level surrounding the conductors can be accurately sensed by measuring the time it takes to charge the conductors to a set voltage, or measuring the voltage of the conductors at a set time.

Figure 6:
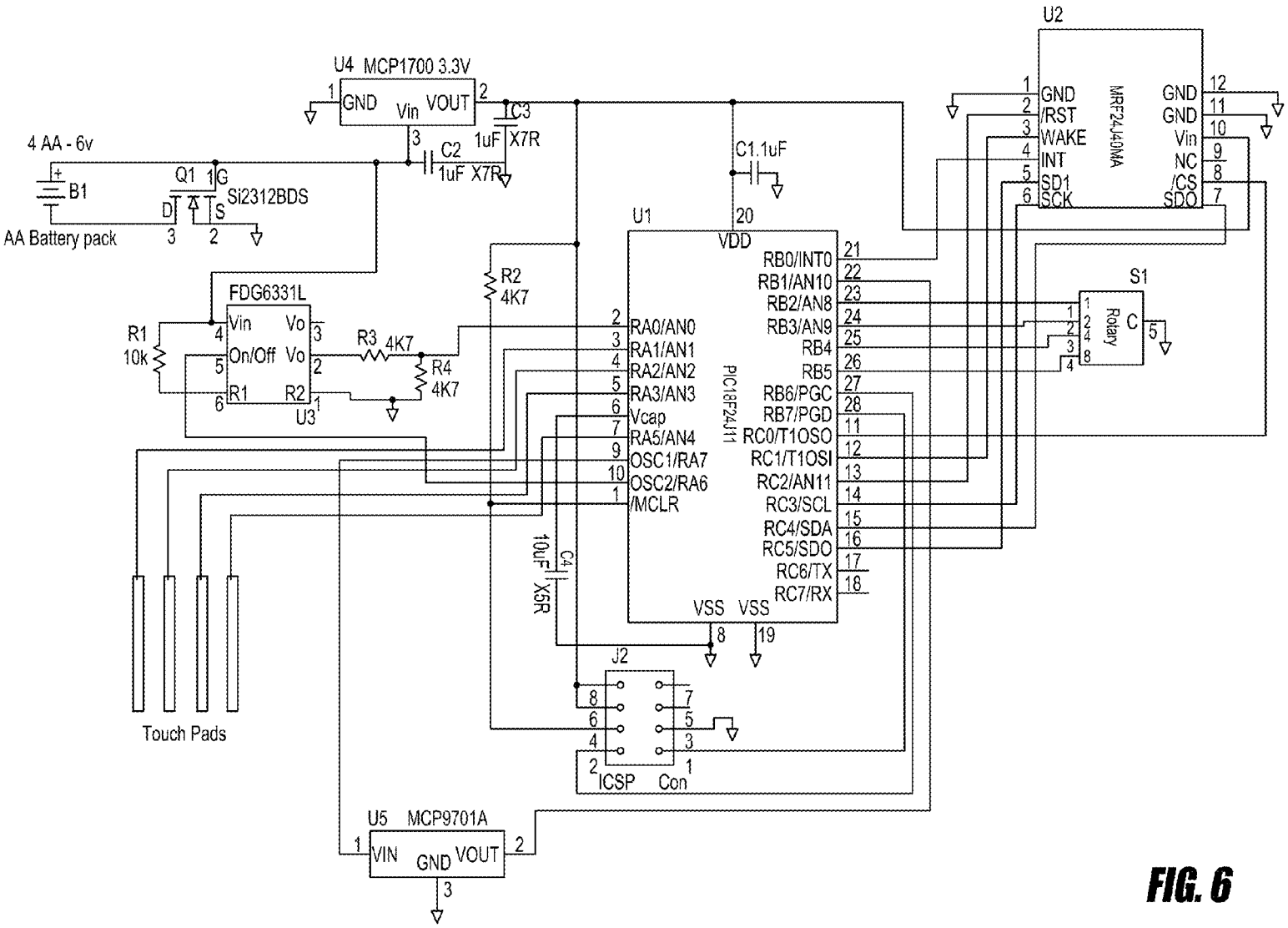
FIG. 6 is a schematic showing one example of a sensor pod circuit implemented with a programmable interface controller (PIC)

In one implementation, the components of the sensor pod 152 are all formed on a printed circuit board (PCB) 154. The conductors 164 can be potted using a non-conductive epoxymeric material for such purpose inside the plastic housing. The conductors can be patterned onto the layers of the PCB 154 that also incorporates power 156, RF 158, and computational 160, 162 electronics to make the sensor fully potted, waterproof and wireless. Changes in the near environment outside of the plastic housing or the insulating layer of the conductor will change the time vs. potential relationship of the conductors. By selecting the patterning and number of the conductors, optimization in the measurements can be achieved. In one preferred embodiment, a set of four conductors are used to provide signal averaging improvements in precision and oversampling to allow increased resolution. Preferably, these four conductors are patterned in 2 inch by 0.2 inch flat strips on a PCB that is designed to slip into a plastic housing and to be potted into place. The conductors in the plastic housing when mounted properly create an insulated conductor that penetrates the surface of the liquids. By measuring the change of time vs. potential of the conductors, changes in the proximity material can be sensed. In the case of a relatively homogeneous liquid material, such as water, the measurement can be used to sense surface level changes. The time vs. potential measurements of the conductors provide an indication of the changes in the environment outside of the plastic housing, which can be used in various other applications as well. FIG. 6 is a schematic showing one example of a sensor pod circuit implemented with a programmable interface controller (PIC).

Figure 7A:
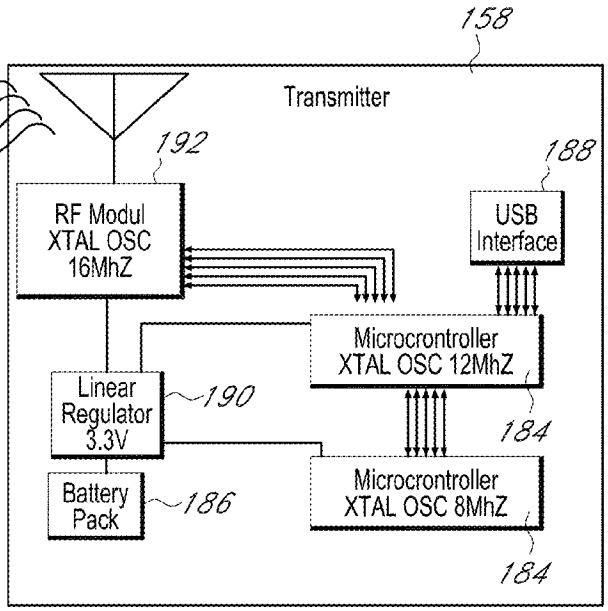
FIG. 7A schematically illustrates the radio frequency transmitter in the sensor pod of one preferred embodiment.
Figure 7B:
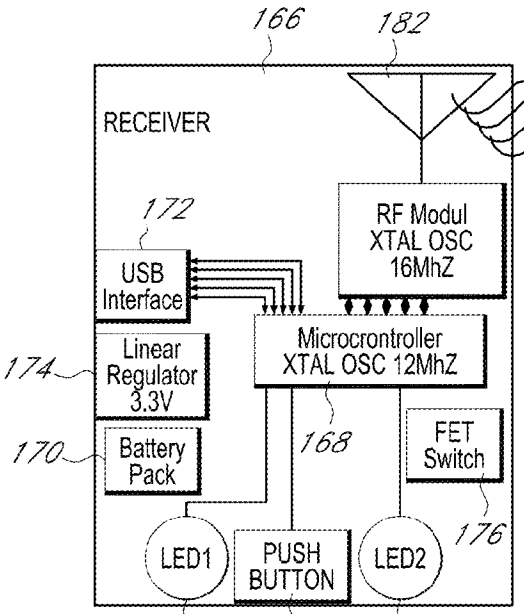
FIG. 7B schematically illustrates the radio frequency receiver in the remote controller of one preferred embodiment.

FIG. 7A schematically illustrates the radio frequency transmitter 158 in the sensor pod adapted to communicate with the remote controller. FIG. 7B schematically illustrates the radio frequency receiver 166 in the remote controller adapted to communicate with the transmitter 158. The receiver 166 generally comprises a microcontroller chip 168, a battery pack 170, a USB interface 172, a linear regulator 174, a FET switch 176, a plurality of LED lights 178, a user interface 180, and a radio frequency module 182. Similarly, the transmitter 158 generally comprises microcontroller chips 184, a battery pack 186, a USB interface 188, a linear regulator 190, and a radio frequency module 192.

In use, the sensor assembly is preferably installed under a skimmer cover or deck lid next to the swimming pool as shown above in FIG. 3A. The sensor assembly is preferably adjusted so that the upper section of the sensor pod is about 20 mm to 25 mm above the water level. The lower flat section of the sensor pod is preferably in the water to a depth of 20 mm to 25 mm at swimming pool operation level. In some embodiments, the remote water valve can be installed between a regulated pressure water supply and the return line to the swimming pool. In one implementation, the remote controller can be mounted up to 25 feet up and away from the remote water valve, which may allow the optimal RF signal placement.

In one embodiment, the automated system 100 has two modes of operation. Mode 1 provides a continuous auto-fill function in which the sensor assembly measures water level and updates the remote controller periodically, such as every 10 minutes, 24 hours a day. The remote controller turns the remote water valve on when the remote controller detects a "low water" signal from the sensor assembly, and turns the remote water valve off if the remote controller does not detect a "low water" signal from the sensor assembly. In one embodiment, the remote controller queries the sensor pod periodically, such as every 10 minutes, for a "low water" signal. Mode 2 allows the system to sleep for 23 hours each day and only takes measurements during one hour of wake time. During the fill cycle wake hour, water level measurements and water valve are updated a number of times, such as 6 times. Since there is only one hour of fill time, the water flow rate should be adjusted to avoid false alarm or overfilling during fill cycles. In this mode, the water valve is automatically shut off if the threshold water level is not achieved for three consecutive days. The system will also send an alarm indicating a possible water leak.

Figure 8:
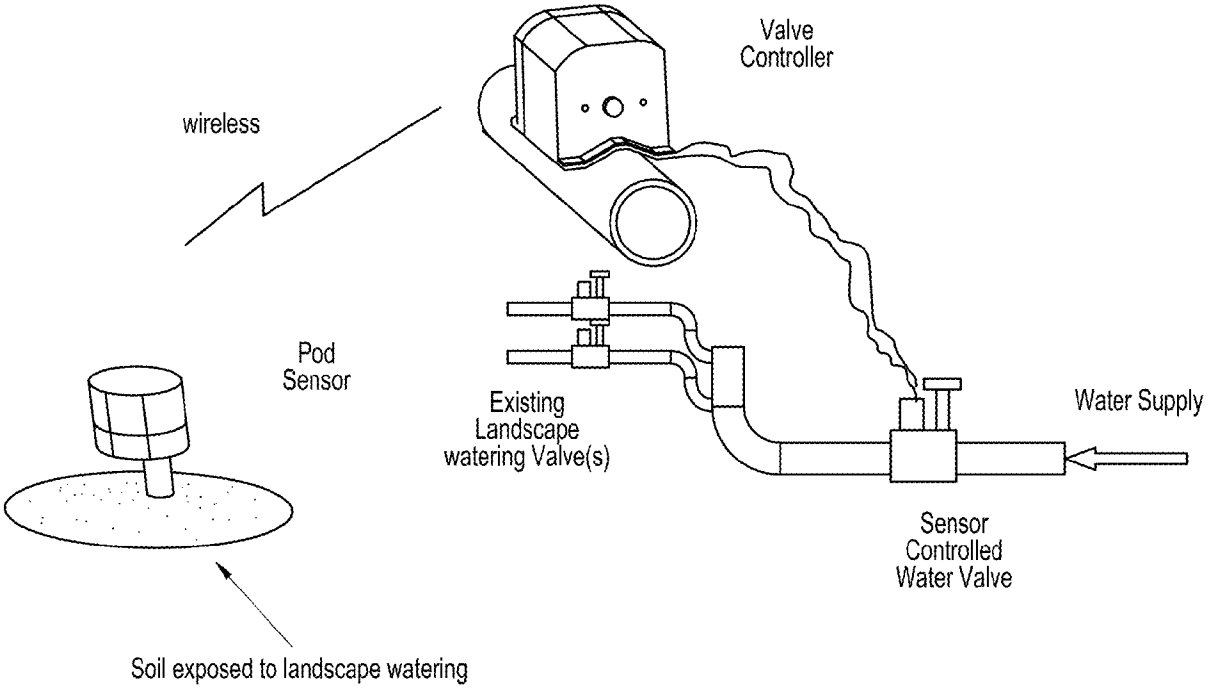
FIG. 8 schematically illustrates an automated system for monitoring and maintaining water level of one preferred embodiment being used to control an irrigation valve for landscape watering.

The system can also be used in other applications such as water conservation for landscape automatic watering systems. The typical landscape is watered based on a timed system and will be watered regardless of the need. Also many landscapes are overwatered or experience remote valve failures. Water can be conserved by using a sensor pod of one preferred embodiment to shut off the water supply to the remote landscape watering system when the soil is adequately saturated water. FIG. 8 shows the automated system of one preferred embodiment being used to control an irrigation valve for watering only when soil is wet. In this embodiment, when the landscape is adequately watered, a master valve is preferably prohibited to allow water supply to the existing timed array of remote valves that are typically arranged to water a landscape.

As described previously, the conductors so encapsulated in an epoxymeric resin poured around the conductor that is resting inside of a plastic housing or in other cases encased in a non-conductive film or material. The coated conductors or sensor pod can be inserted into the soil in the landscape in a representative area where upon saturation the landscape is adequately watered. After inserting the sensor pod into the soil as shown in FIG. 8, the soil or landscape is preferably brought to optimal saturation levels. Recording the charge time of the conductor to a set potential or the potential in a given time at a constant charge rate provides a baseline of the environment near the conductor. A change in the conductive environment outside of the encased conductor due to changes in the soil moisture can be used activate a solenoid remote valve that controls the water supply to the landscape. The existing landscape remote valves can continue to operate. When the soil is moist due to any reason and more specifically to the optimal point set previously, the water supply is turned off to the landscape. When the soil moisture is optimal an off signal to a master remote valve and no water is allowed to moisten the already moist landscape.

In certain preferred embodiments, the sensor assembly 120 has the stimulus and response in the range and resolution enabling rapid change detection of water level. In one implementation, the sensor data resolution has a minimum value of about 0.003 inch. In another implementation, the sensor working measurement range is greater than about 0.2 inch. Preferably, the sensor response data is immediately processed and interpreted according to certain algorithms to be described in greater detail below. The results can be displayed on a display readout disposed on the sensor pod and/or on the remote controller.

In one embodiment, an algorithm for the fill function begins with step 1 which measures 2048 measurements at a frequency of 1000 Hz, followed by step 2 which entails sum measurements and divide by number of measurements. If value is not less than threshold as determined in Step 3, the process goes back to step 1. The process continues with Step 4 which entails calculating the slope of best fit line using least square regression mathematics. If the slope is greater than threshold evaporation set slope value for next 100 measurements then the process alerts leak by illuminating LED on control panel, and then turns off fill function until reset by user. If the slope is less than threshold set to evaporation and level is not below preset threshold level, then the process goes back to step 1. If the slope is less than threshold and level is below set threshold value, then the process activates fill by sending a signal to the remote controller. The process continues with measure 2048 measurements at a frequency of 1000 Hz. Sum measurements and divide by number of measurements. If water level is greater than fill stop level, turn off fill function and go to Step 1.

The automated fill function in one embodiment may include the following features: the MSL data can be logged and recovered; threshold, alarming rates and MSL data can be managed off device by blue tooth or other wireless or wired connection; water can be remotely controlled via irrigation valve, or other wired or wireless remote valve located near or distant from container and sensor and microprocessor control unit; leak detection capabilities enable monitoring for both plumbing and structure leaks during the lifetime of the installation of the container; and sensor enables the inventory monitoring of fluids at distances.

Figure 9:
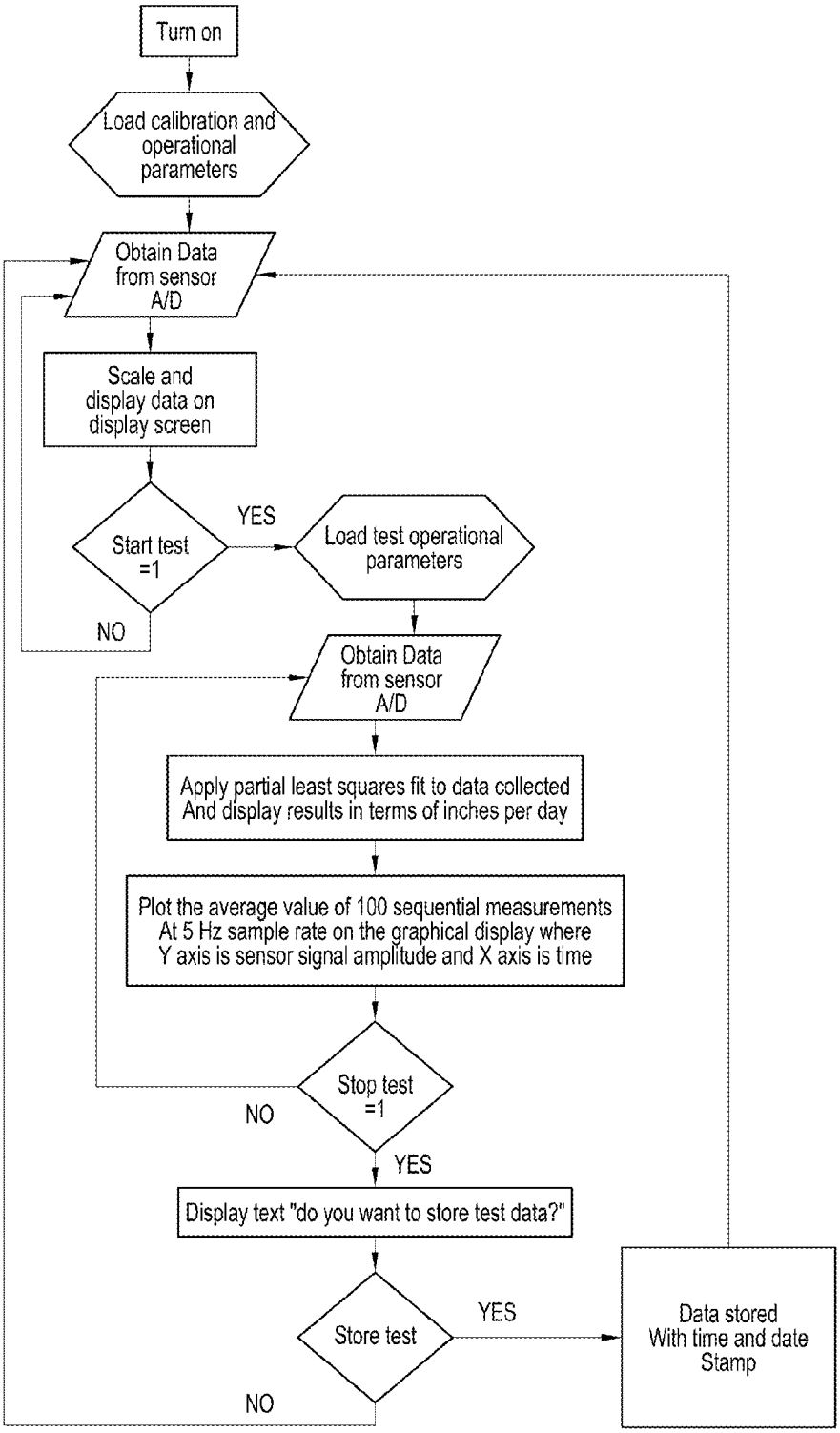
FIG. 9 illustrates a test and store data algorithm of one preferred embodiment.
Figure 10:
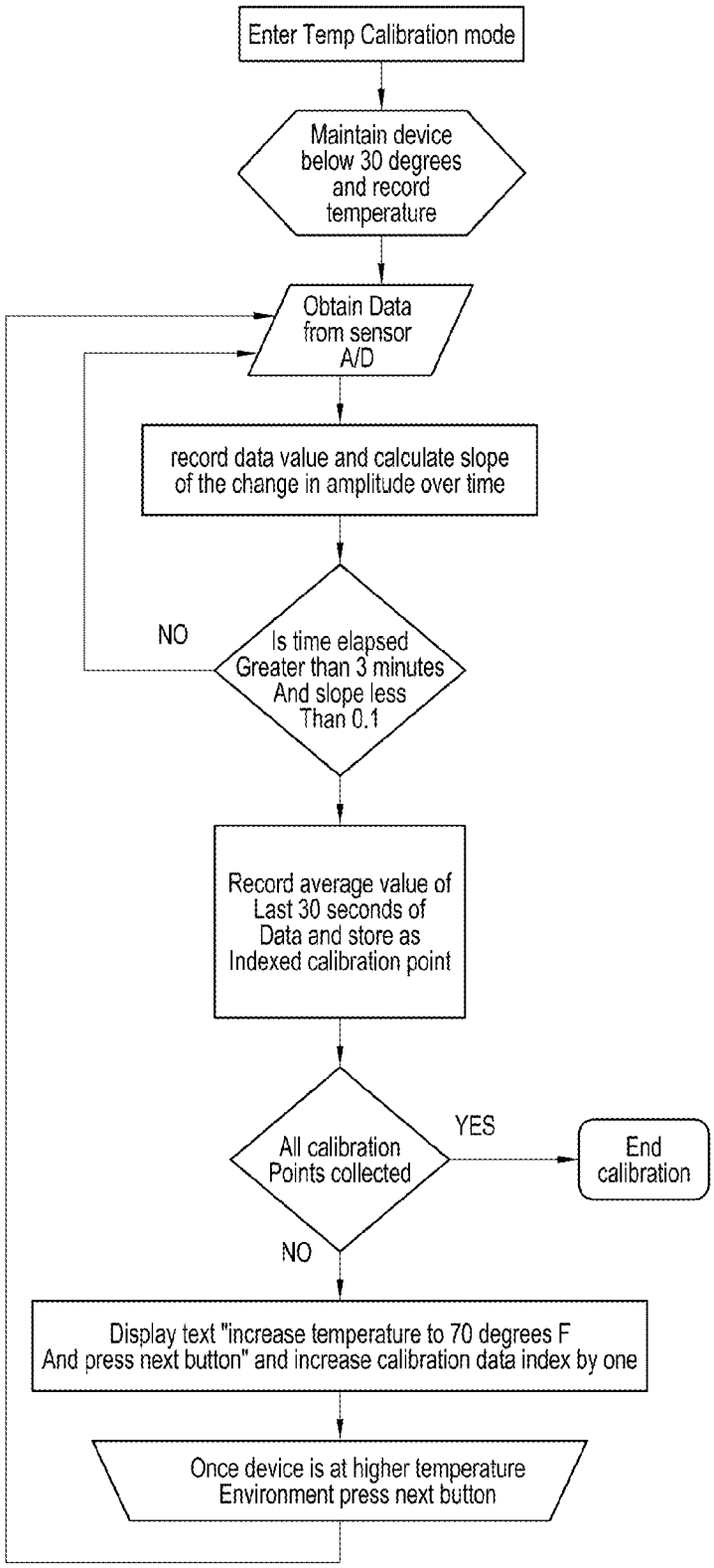
FIG. 10 illustrates a calibration algorithm of one preferred embodiment.
Figure 11:
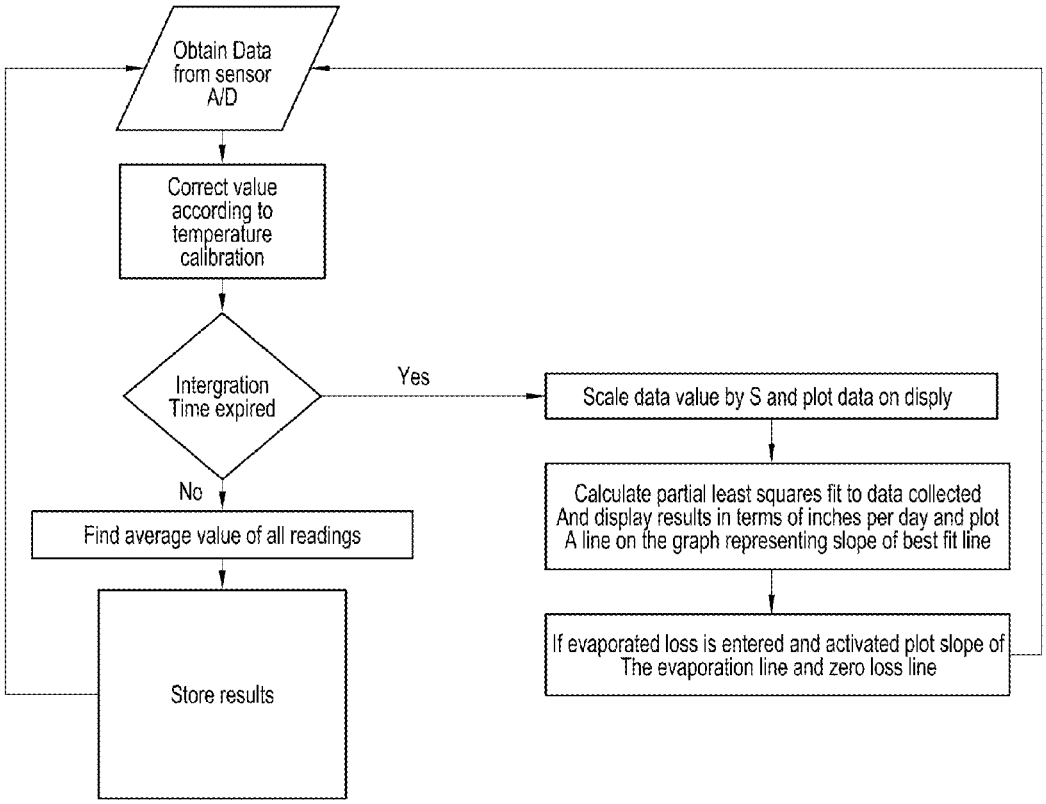
FIG. 11 illustrates an integration, scaling, and graphical display algorithm of one preferred embodiment.
Figure 12:
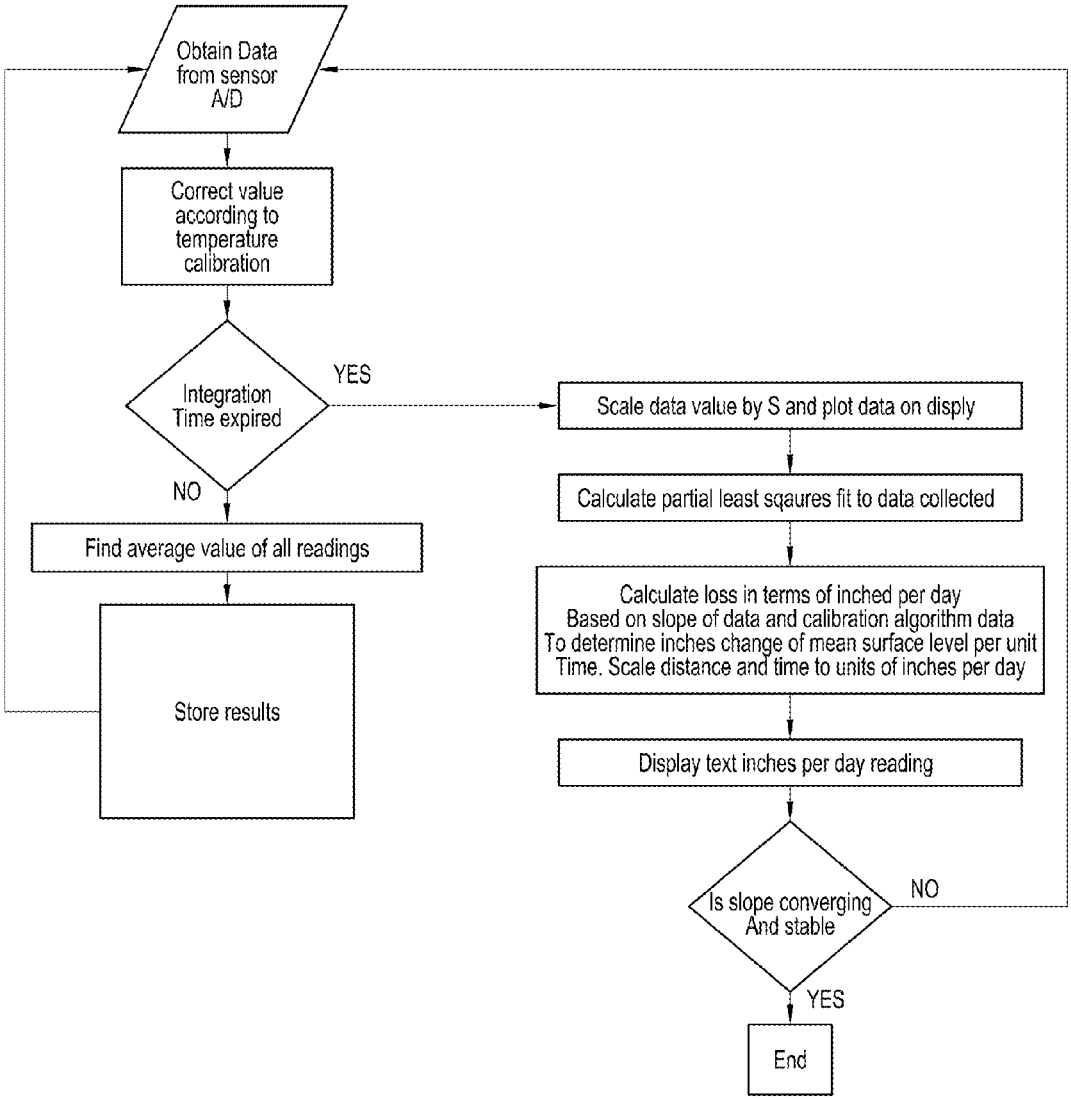
FIG. 12 illustrates a reporting algorithm of one preferred embodiment.
Figure 13:
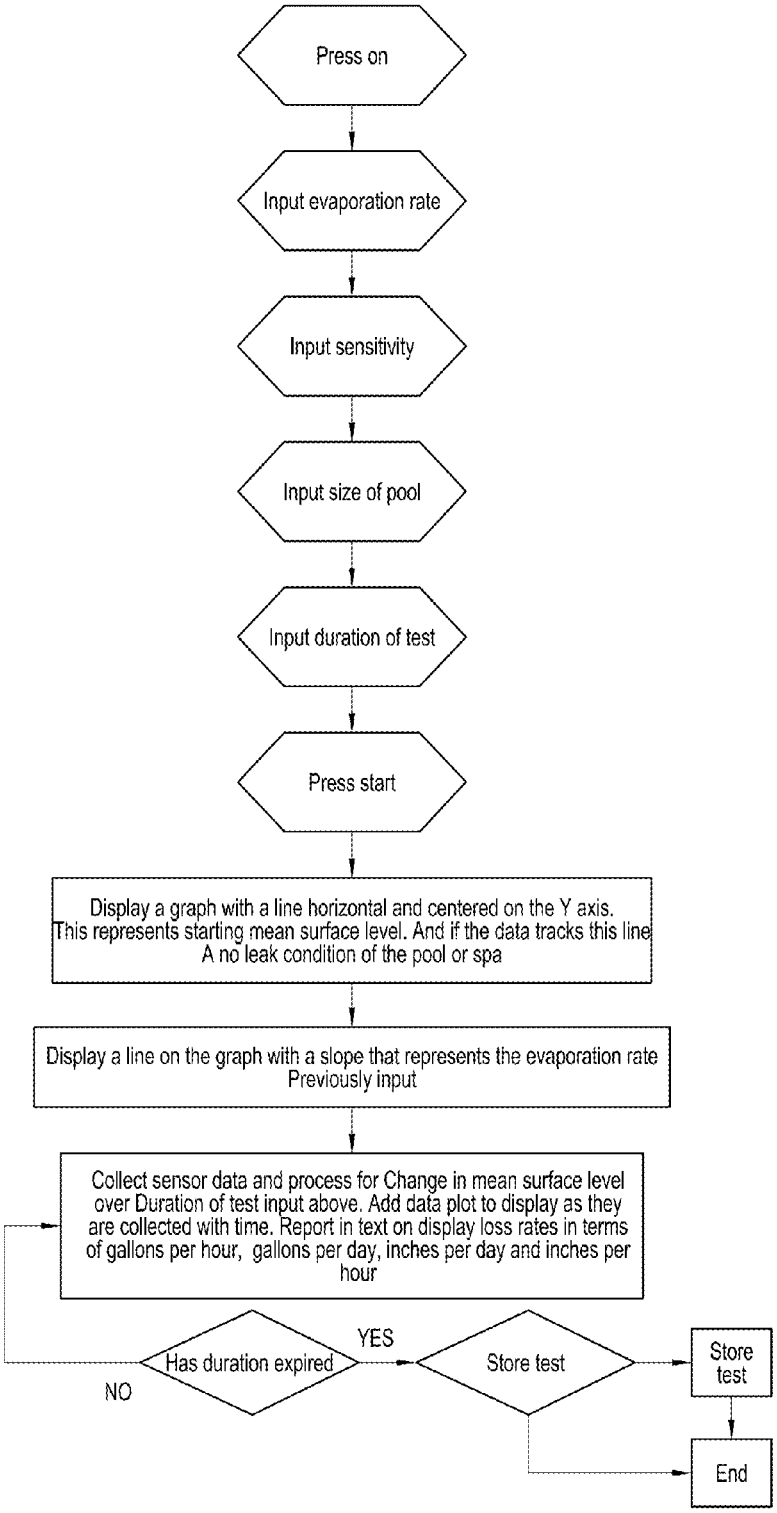
FIG. 13 illustrates a pool leak detection process flow chart of one preferred embodiment.
Figure 14:
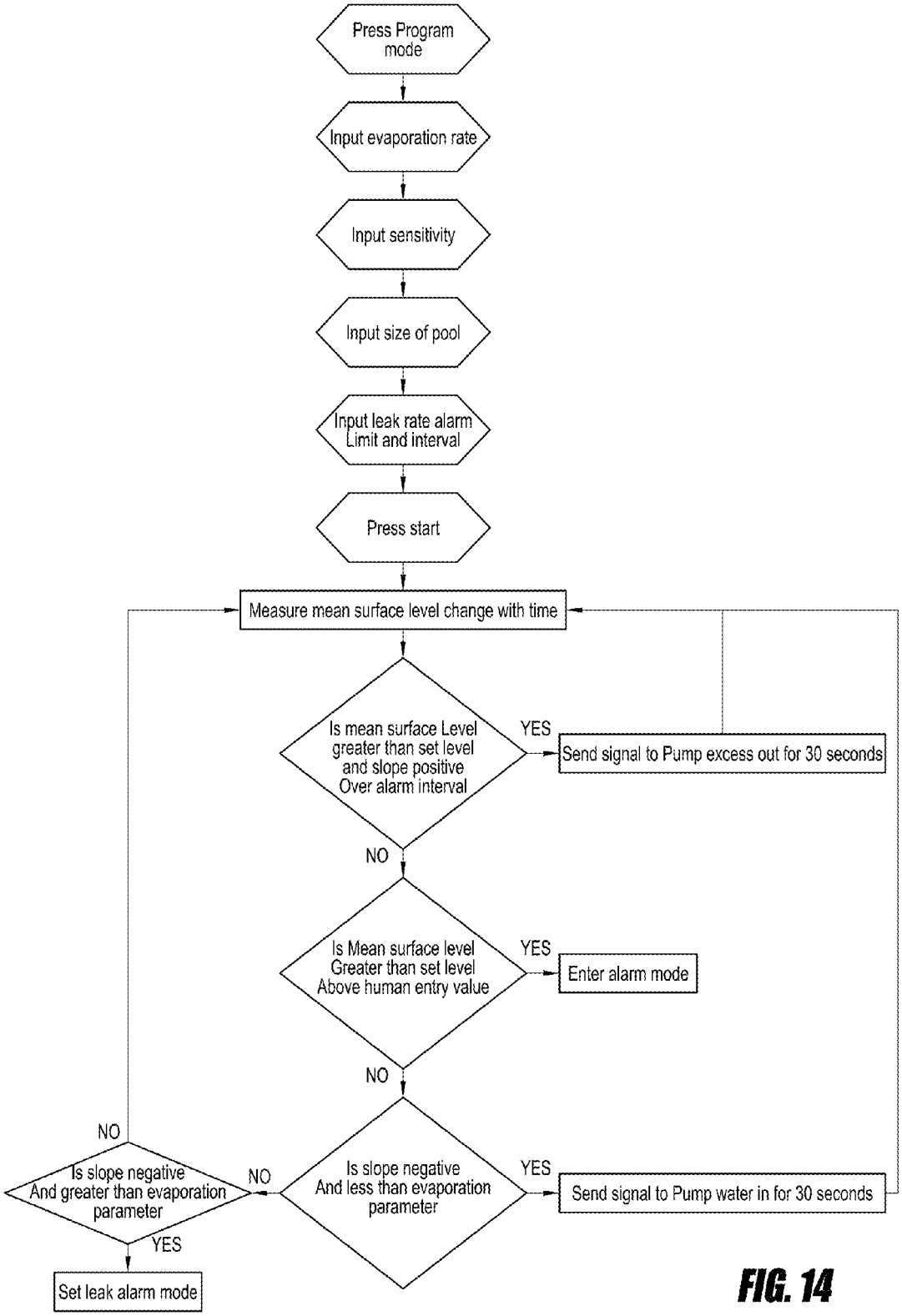
FIG. 14 illustrates a pool leak detection process flow chart of another preferred embodiment.

Various preferred algorithms have been developed to work in conjunction with the automated system of the preferred embodiments to rapidly and accurately detect need for water refill in pools, spas, storage containers and the like. FIG. 9 illustrates a test and store data algorithm of one preferred embodiment. FIG. 10 illustrates a calibration algorithm of one preferred embodiment. FIG. 11 illustrates an integration, scaling, and graphical display algorithm of one preferred embodiment. FIG. 12 illustrates a reporting algorithm of one preferred embodiment. FIG. 13 illustrates a pool leak detection process flow chart of one preferred embodiment. FIG. 14 illustrates a pool leak detection process flow chart of another preferred embodiment.

The appropriate combination of physical properties of the sensor assembly, the sensitivity and range of the level sensor and the algorithmic methods, some examples of which are described herein, enable the rapid determination of MSL changes of the water level. In some preferred embodiments, the MSL information provides diagnostic and absolute data on the flux of liquid into and out of pool that can be used to assess the loss of the system and integrity of the pool and associated plumbing network. Certain preferred embodiments allow for the measurement of leaks in containers such as pools, spas, lakes, water feature and associated plumbing serving the same in a very short time by increasing the SNR or the signal being the MSL over the noise being the localized changes in surface level. In some implementations, this signal to noise is as high as possible to obtain rapid measurements of the MSL.

Performance is measured in signal over noise (SNR). The SNR is an important factor in some applications where the rate of change of the mean surface level of a body of liquid is important. In one preferred embodiment such as a professional pool leak detection device performance is measured by rapidity of obtaining reliable measurement results on the rate of change of the mean surface level of the pool under test. There is a direct relationship between SNR and speed of obtaining a reliable rate of change measurement in the surface of a body of liquid. The combination of attributes in this one embodiment provides performance not previously available. Surface turbulence and wave action can thwart important rapid fluid level change measurements in the field. Environment and weather such as wind, rain, humidity, temperature, and other factors have a profound effect on the speed at which precise and accurate measurements can be made for a given confidence interval. Small relative changes over time of the true-surface-position of fluids made turbulent by flow or exposure are difficult to obtain and especially difficult to obtain in short periods of time. The systems of the preferred embodiments have demonstrated an improvement of measure each improved incrementally by application of device engineering, proper methodology and application of special signal processing and data processing algorithms.

The attributes of certain preferred embodiments enable rapid measurement of pools, spas and water features in the field of use of water level control and leak detection. The combination of attributes enables the use of more sensitive sensors for the measure of the MSL that also have greater range and sensitivity than would otherwise be possible to use. These features make the device easier to set up and use and provide a dramatic increase in the ability to automatically control the water level. Certain preferred embodiments also improve the range of diagnostics that one can apply to the leak detection of pools, spa, lakes and water features. The preferred embodiments are not limited to water and can be applied to any liquid and any container with a sound edge reference position. The preferred embodiments further improves the capabilities to measure the MSL of turbulent bodies of liquids by applying special signal processing, signal conditioning and mathematical algorithms before displaying the data in relevant terms to the end user. In another preferred embodiment the sensor system can be utilized to control fill and drain functions that follow a preset user dictated routine for pool water conservation and fluid inventory management.

Although the foregoing description of the preferred embodiments of the present invention has shown, described and pointed out the fundamental novel features of the invention, it will be understood that various omissions, substitutions, and changes in the form of the detail of the invention as illustrated as well as the uses thereof, may be made by those skilled in the art, without departing from the spirit of the invention. Particularly, it will be appreciated that the preferred embodiments of the invention may manifest itself in other shapes and configurations as appropriate for the end use of the article made thereby.

What is claimed is:

1. An automated system for monitoring and maintaining fluid level in an environment containing fluid, comprising:

a sensor assembly comprising a proximity sensor and a transmitter, said proximity sensor comprising one or more conductors encapsulated in a substantially non-conductive material having a thickness up to 7 mm thick, wherein the conductors are disposed in a lower section of the sensor assembly, said lower section having a generally flat profile and a cross sectional thickness between 2 mm and 10 mm;

a remote controller, said remote controller is operatively connected to at least one fluid control valve and in communication with the sensor assembly;

a substantially watertight housing, said housing having a wall that encloses the sensor assembly in a manner such that the one or more conductors does not directly contact the fluid, wherein the housing wall adjacent to the proximity sensor is between 1 mm to 3 mm;

wherein the sensor assembly senses fluid level changes in the environment by measuring an amount of time required for the conductors to charge to a preset voltage, wherein the sensor assembly transmits a signal to the remote controller when a measured fluid level deviates from a predetermined target value, wherein the remote controller turns the fluid valve on or off in response to the signal.

2. The system of claim 1, wherein the proximity sensor and transmitter are formed on a printed circuit board.

3. The system of claim 1, wherein the sensor assembly further comprising a mount system having an attachment mechanism configured to couple with an opening on a skimmer deck lid in a manner such that the sensor assembly is configured to be mounted on an underside of the skimmer deck lid in a manner such that the proximity sensor is affixed at multiple predetermined levels, wherein the mount system comprises a spacer having a plurality of slots.

4. The system of claim 1, wherein the sensor assembly further comprises a sensing algorithm, the mount system works in combination with the sensing algorithm to provide greater range and resolution in the determination of the preferred set level.

5. The system of claim 1, wherein the environment containing fluid is a swimming pool.

6. The system of claim 1, wherein the environment containing fluid is irrigation landscape.

* * * * *